United States Patent [19]

Crawford

[11] Patent Number: 4,803,879

[45] Date of Patent: Feb. 14, 1989

[54] SLIP LOCK FORMING APPARATUS

[76] Inventor: Robert J. Crawford, Box 108 Burnett Rd., Wakefield, Quebec, J0X 3G0, Canada

[21] Appl. No.: 10,532

[22] Filed: Feb. 3, 1987

[30] Foreign Application Priority Data

Dec. 30, 1986 [CA] Canada ..... 526492

[51] Int. Cl.[4] ..... B21D 5/04

[52] U.S. Cl. ..... 72/322; 72/306; 72/381

[58] Field of Search ..... 72/322, 323, 306, 307, 72/316, 381, 384, 386

[56] References Cited

U.S. PATENT DOCUMENTS

| | | | |
|---|---|---|---|
| 563,798 | 7/1896 | Peters | 72/322 |
| 2,734,552 | 2/1956 | Yonash | 72/322 |
| 4,133,198 | 1/1979 | Huda et al. | 72/322 |
| 4,510,785 | 4/1985 | Triouleyre et al. | 72/323 |
| 4,515,001 | 5/1985 | Zahn | 72/323 |
| 4,656,861 | 4/1987 | Koyama et al. | 72/316 |

FOREIGN PATENT DOCUMENTS

| | | | |
|---|---|---|---|
| 2825591 | 5/1979 | Fed. Rep. of Germany | 72/322 |
| 613270 | 12/1960 | Italy | 72/306 |
| 77031 | 6/1981 | Japan | 72/306 |

*Primary Examiner*—David Jones

*Attorney, Agent, or Firm*—Berman, Aisenberg & Platt

[57] ABSTRACT

There is provided a new and useful slip lock forming apparatus comprising a support structure, a forming die mounted on the support structure, a clamping mechanism mounted on the support structure and comprising a pair of clamping members movable between an open and a closed position for holding a workpiece in position relative to the die, a press mechanism mounted on the structure and comprising a pair of pressing surfaces at least one of which is movable relative to the other between a first position in which the surfaces are in contact and a second position in which the surfaces are spaced from each other, and a forming bar mounted on the structure and movable between a retracted position and an extended position for forming a workpiece around the die.

16 Claims, 3 Drawing Sheets

SLIP LOCK FORMING APPARATUS

This invention relates to a slip lock forming apparatus.

BACKGROUND OF THE INVENTION

This invention arises in the sheet metal forming context. Sheet metal flashing utilized for sealing and finishing roof edges is produced in the form of custom formed elongated sheets of varying length. In use the sheets are customarily interlocked at their ends by means of a conventional slip lock joint. This joint is effected by forming in one end of the sheet a slip lock which is essentially in the form of a flattened "S". The unformed end of an adjacent sheet is simply slid into the fold presented by the slip lock.

This slip lock must be formed on substantially every piece of flashing used in the roofing industry. As presently practiced the formation of the slip lock is a very labour intensive and therefore expensive procedure. There is therefore a need for a means of forming a slip lock in a more efficient manner than that presently utilized. It is against this background that the present invention arises.

PRIOR ART

The slip lock in sheet metal flashing is currently formed manually utilizing a conventional press brake. All manipulation of the sheet metal sheet or work piece is performed by a sheet metal worker and activation of the press brake for each step in the forming process is effected manually. This manual procedure is actually in use throughout the roofing industry.

SUMMARY OF THE INVENTION

A slip lock forming apparatus has now been devised which introduces a substantial degree of automation to the forming process. Fluid actuated cylinders and pistons are utilized with forming dies to automatically perform the necessary bending operations on the metal flashing.

Thus there is provided a slip lock forming apparatus comprising a support structure, a forming die mounted on the support structure, a clamping mechanism mounted on the support structure and comprising a pair of clamping members movable between an open and a closed position for holding a workpiece in position relative to the die, a press mechanism mounted on the structure and comprising a pair of pressing surfaces at least one of which is movable relative to the other between a first position in which the surfaces are in contact and a second position in which the surfaces are spaced from each other, and a forming bar mounted on the structure and movable between a retracted position and an extended position for forming a workpiece around the die.

BRIEF DESCRIPTION OF THE DRAWINGS

In drawings which illustrate embodiments of the invention.

Figure 2:
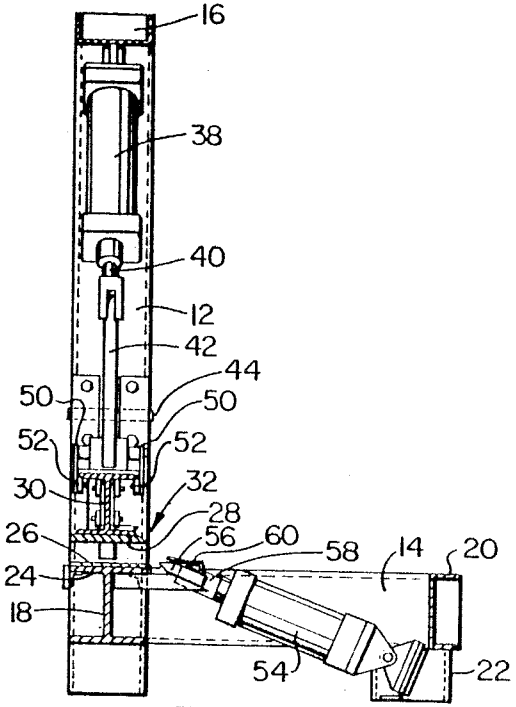
FIG. 2 is an end elevation partly in section of the apparatus of FIG. 1.
Figure 1:
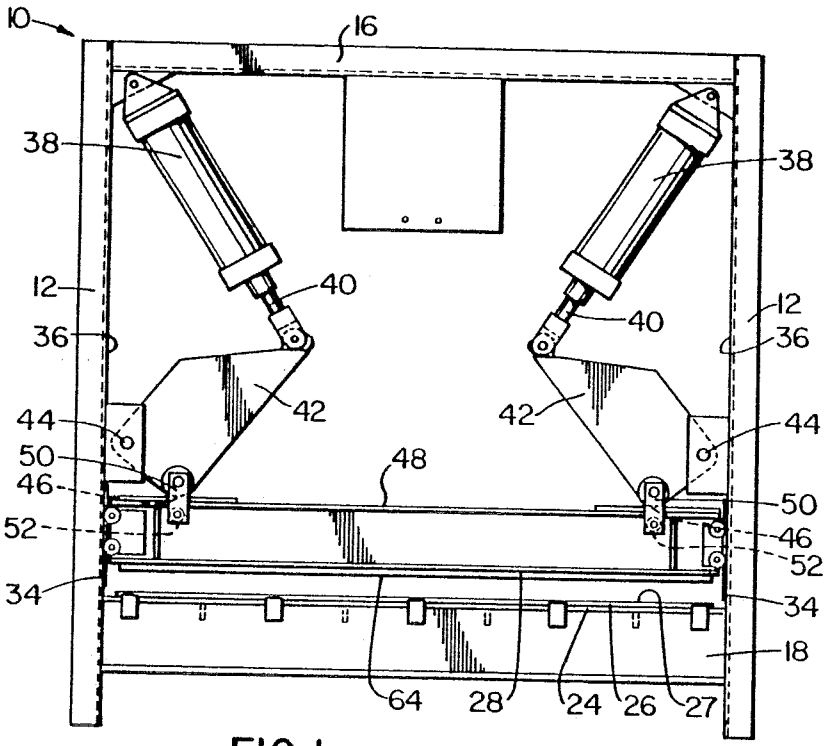
FIG. 1 is a front elevation partly in section of the forming apparatus according to the invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

The forming apparatus 10 includes a support structure comprising the uprights 12 and the rearwardly extending members 14 joined by upper cross member 16, lower cross member 18 and rear cross member 20. The support structure includes the short uprights 22 depending from the rearward ends of members 14.

The upper surface 24 of lower cross member 18 comprises one surface of a pair of clamping surfaces. The surface 24 is preferably provided with a liner 26. The lower surface 28 of a cross member 30 forms the second of the pair of clamping surfaces. However, the surface 28 preferably has attached to it or integral with it the forming or braking die 32. The configuration and function of die 32 are discussed below.

Cross member 30 is mounted for reciprocal movement along the guides 34 fixed to the inside surface 36 of the uprights 12. The member 30 is driven by a pair of hydraulic or pneumatic cylinders 38. The cylinders are preferably pneumatic and preferably operate at pressures in the 80–100 psi range or similar conventional pressure normally available in a sheet metal shop.

The piston rods 40 associated with cylinders 38 transmit force to the cross member 30 through the plates 42. The plates 42 are effectively levers pivotting about fulcrums 44 and transmitting a vertical force component onto the member 30 at the contact points 46. As the piston rods 40 extend and the plates 42 rotate about the pivot points 44, the contact points 46 move horizontally along the upper surface 48 of cross member 30.

As described below, the force exerted between the clamping surfaces enables those surfaces to perform a press function as well. Alternatively, a separate press mechanism mounted on the structure and comprising a pair of pressing surfaces at least one of which is movable relative to the other between a first position in which the surfaces are in contact with each other and a second position in which the surfaces are spaced from each other. The cross members 18 and 30 may be described as press clamp members.

Upon retraction of the piston rods 40, the hangers 50 and rollers 52 cause the cross member 30 to move upwardly. The rollers 52 permit the lifting assembly to follow the plates 42 through the horizontal component of rotation.

With reference to FIG. 2, a further pair of cylinders 54 are mounted on uprights 22 at a predetermined and fixed angle above the horizontal. A second forming die or bar 56 is mounted across the rods 58 associated with cylinders 54. The bar 56 is thus extended or retracted as dictated by cylinders 54 and rods 58.

A guide member 60 is mounted on the bar 56.

Turning to the dies per se, the preferred shape is illustrated in the schematic figures. The operative part of die 32 is the wedge shaped section 62. The bottom side 64 of wedge 62 is preferably horizontal, and the upper side 66 of wedge 62 is preferably at an angle 0° of 45° to bottom side 64. The angle is not critical.

Die 32 also preferably includes a smaller wedge-shaped part 68 the lower side 70 of which forms an angle with the upper side 66 of wedge-shaped section 62. Again, the angle is not critical, but is preferably about 90°.

The operative part of the second forming die or bar 56 is the section 72 which is also preferably wedge shaped. The angle o between the upper side 74 and lower side 76 of section 72 is preferably the complement of the angle o and so is preferably 45 degrees.

While no specific control system for the apparatus is illustrated, the system is of conventional design and may take a variety of configurations as may be desired for convenience and safety. Preferred options are discussed below.

The width of the apparatus may be varied to fit a particular application, but for conventional flashing most stock can be accommodated by a three foot width.

Figure 3:
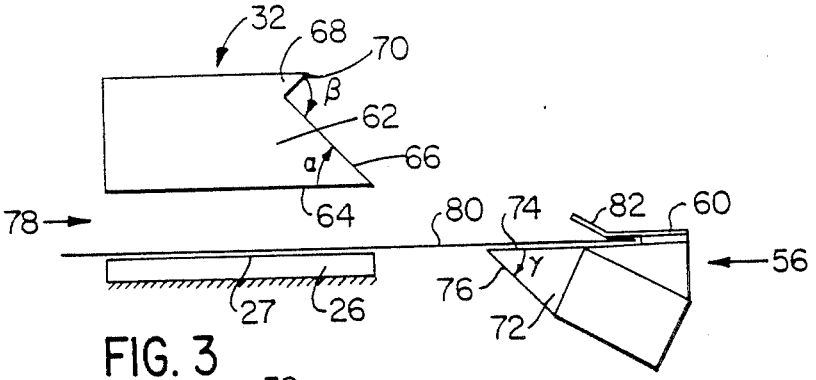
FIGS. 3 to 9 illustrate schematically and sequentially steps performed by the apparatus of FIGS. 1 and 2.

The operation of the apparatus is as follows. The whole structure is preferably enclosed in a sheet metal cabinet which presents to a sheet metal worker an open slot 78 leading between the surface 27 of liner 26 and lower surface 64 of die 32. As illustrated in FIG. 3, the first step in the process is for a sheet metal worker to insert a workpiece 80 comprising a flat sheet of metal flashing through the slot 78 to bring up against the guide member 60. In the preferred case the guide member 60 includes an upwardly directed lip 82 to aid in guiding the end of workpiece 80 into guide member 60.

Figure 4:
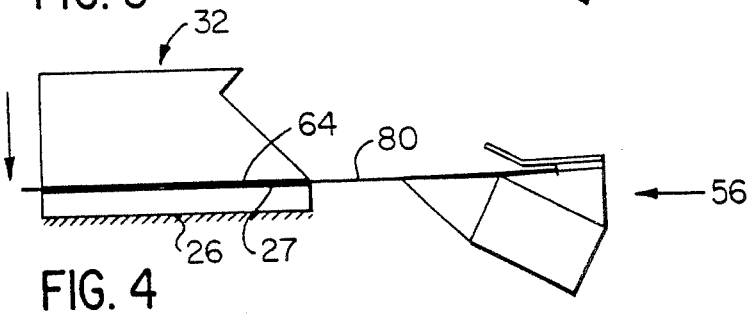

Once the workpiece 80 is in position, a switch, preferably a push button type, is pressed to activate, through electrical connection (not illustrated), necessary valving on the cylinders 38 to extend rods 40 and through the linkage described above to lower the cross member 30 and die 32. As illustrated in FIG. 4, the workpiece 80 is then clamped between the surface 27 of liner 26 and the lower surface 64 of die 32.

Figure 5:
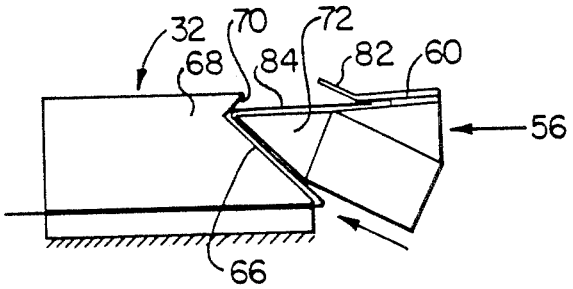

By a conventional sequential control system, the cylinders 54 are then preferably automatically activated to extend the rods 58 and with them the forming bar 56. As the bar 56 extends, as illustrated in FIG. 5, the workpiece 80 is broken about the wedge-shaped dies 62 and 72 to form a somewhat flattened "S"-shaped end configuration.

The formation of the upper arm 84 of the "S"-shaped configuration is facilitated by a combination of the guide member 60 and the lower side 70 of the smaller wedge-shaped die part 68. While the guide member 60 will generally hold the end of workpiece 80 in the desired configuration, the jamming effect of the forming bar 56 in the angle between the surfaces 66 and 70 creates a good sharp break to facilitate the final forming step.

Figure 6:
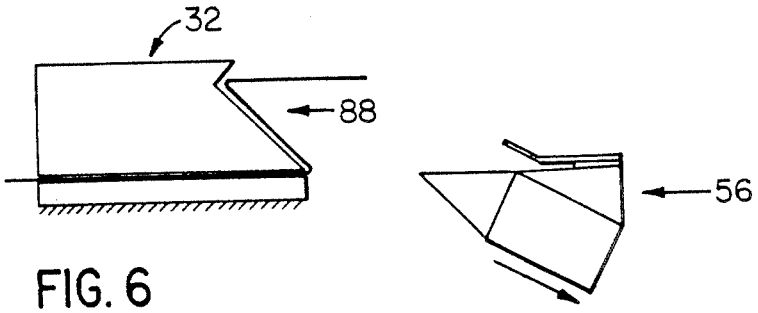
Figure 7:
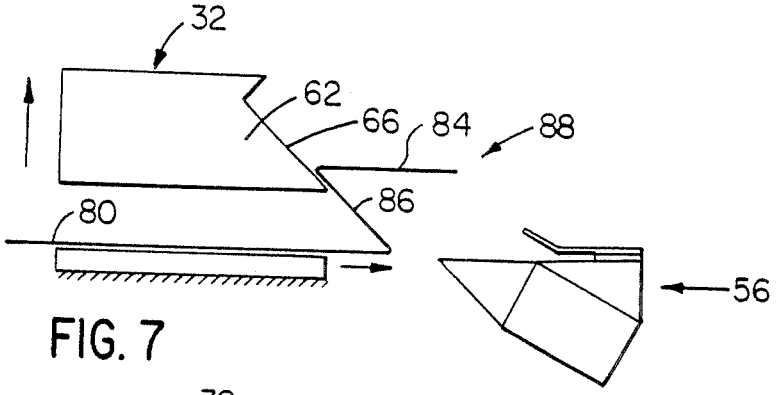
Figure 8:
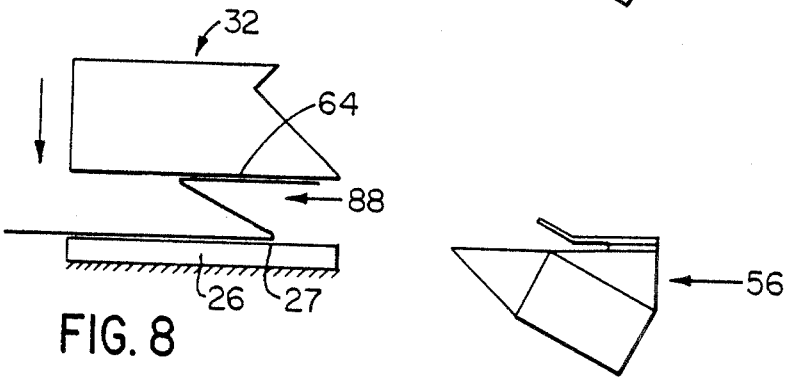
Figure 9:
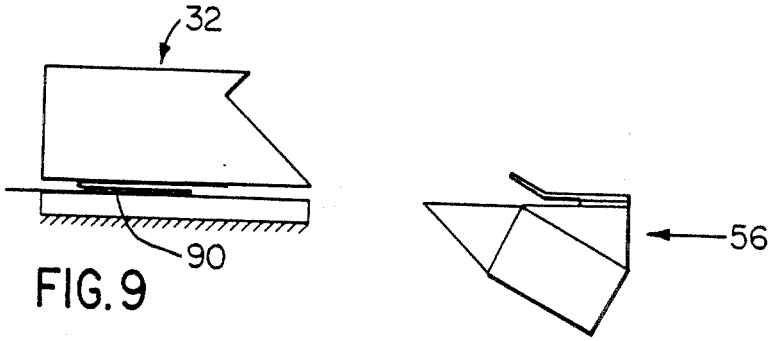

The next two steps as illustrated in FIGS. 6 and 7 are also preferably carried out automatically utilizing conventional sequential control. As illustrated in FIG. 6 the forming bar 56 is withdrawn and the cross member 30 with die 32 raised. As shown in FIG. 7, there is interference between the sloped arm 86 of the "S"-shape and the surface 66 of die 32, but this is accommodated without adverse effects by a combination of the resilience of the metal of the workpiece 80 and movement of the workpiece to the right as shown in the drawing. This movement is caused by the interference.

Once the cross member 30 has moved back to its initial position, the workpiece is withdrawn by the sheet metal worker so that the "S"-shaped end 88 is located between the surfaces 27 and 64. A second switch is then activated to lower the cross member 30 to press the open "S"-shaped end 88 of workpiece 80 into the closed slip lock configuration 90. The cross member 30 is then automatically raised, the workpiece 80 withdrawn and the operation is complete.

A separate press mechanism could be utilized, but efficiency is improved by combining the clamping and pressing function in the members 18 and 30.

Various other suitable control systems can be devised for the apparatus, but clearly the forming steps will be the same. For example, a safety override is preferred for the second activation of the cross member 30 to ensure that an operator's hands are clear before the cross member 30 is lowered. For this purpose a dual switch requirement may be imposed whereby both a foot and a hand switch are required to be activated to activate cross member 30.

As well, the apparatus may be provided with an additional guide means for positioning the open "S"-shape 88 properly between the surfaces 27 and 64 and for squaring up the metal flashing. In practice these surfaces are substantially broader than the "S"-shaped end 88, so there is a considerable variation of the acceptable positioning.

Thus it is apparent that there has been provided in accordance with the invention a slip lock forming apparatus that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A slip lock forming apparatus comprising:

a support structure;

a press clamp mechanism mounted on said support structure and comprising a pair of press clamp members at least one of which is movable relative to the other between a first position in which said surfaces are in contact and a second position in which said surfaces are spaced apart from each other;

a forming die integral with one of said press clamp members and including a forwardly extending wedge section having a leading edge and first and second surfaces extending back from said leading edge, wherein said first surface is adapted to engage a workpiece, said die further including a stopping and forming surface projecting from said second surface at an angle $\beta$ up to about 90 degrees to said second surface; and a forming bar mounted on said structure and movable between a retracted position adapted to lie on the opposite side of a workpiece from said forming die, and an extended position, wherein said bar includes a leading edge and is oriented such that said leading edge in moving between said retracted and extended position follows a path which is generally parallel to said second surface of said forming die, said leading edge in said extended position of said bar lying substantially at said second surface such that a workpiece between said bar and said second surface would be jammed against said second surface.

2. The apparatus of claim 1 in which said press clamp mechanism comprises a first stationary member fixed to said structure and a second movable member movable between a closed position in clamping and pressing engagement with said stationary member and an open position spaced from said stationary member.

3. The apparatus of claim 2 in which said forming die is mounted on said second movable member.

4. The apparatus of claim 2 in which said forming die is integral with said second movable member.

5. The apparatus of claim 1 in which said wedge forms an angle of about 45° at the leading edge thereof.

6. The apparatus of claim 1 in which said forming bar is wedge shaped.

7. The apparatus of claim 1, in which said forming bar is wedge shaped, the leading edge of said forming bar is oriented to fold a workpiece about the leading edge of said forming die, and said stopping and forming surface is oriented to reactively fold said workpiece about the leading edge of said forming bar, when said forming bar is moved from said retracted to said extended position.

8. The apparatus of claim 1 including guide means mounted on said forming bar and adapted to receive the end of a workpiece therein when a workpiece is inserted into said apparatus and to maintain said end of said workpiece therein in the original orientation of said workpiece until said forming bar is moved from an extended to a retracted position.

9. The apparatus of claim 1 including at least one pneumatic clamping cylinder for driving said clamping mechanism and at least one pneumatic forming cylinder for driving said forming bar.

10. The apparatus of claim 9 including two said clamping and two said forming cylinders.

11. The apparatus of claim 9 including control apparatus to operate said clamping mechanism and said forming bar sequentially responsive to a single input command.

12. A slip lock forming apparatus comprising:

a support structure;

a press clamp mechanism mounted on said support structure and comprising a pair of press clamp members at least one of which is movable relative to the other between a first position on which said surfaces are in contact and a second position in which said surfaces are spaced from each other;

a forming die integral with one of said press clamp members and including a forwardly extending wedge section having a leading edge and first and second surfaces, wherein said first surface is adapted to engage a workpiece;

a forming bar mounted on said structure and movable between a retracted position adapted to lie on the opposite side of a workpiece from said forming die, and an extended position, wherein said bar includes a leading edge and is oriented such that said leading edge in moving between said retracted and extended position follows a path which is generally parallel to said second surface of said forming die, said leading edge in said extended position of said bar lying very close to said second surface; and a guide member mounted on said forming bar adapted to receive the end of a workpiece therein when a workpiece is inserted into said apparatus and to maintain said end of said workpiece therein in the original orientation of said workpiece until said forming bar is moved from an extended to a retracted position.

13. The apparatus of claim 12 wherein said guide member comprises a slot.

14. The apparatus of claim 13 wherein said guide member includes thereon an outwardly flared outer edge.

15. The apparatus of claim 14 in which said wedge section forms an angle of about 45° at the leading edge thereof.

16. The apparatus of claim 14 in which said forming bar is wedge shaped.

* * * * *